US006122780A

United States Patent [19]

Taylor

[11] Patent Number: 6,122,780

[45] Date of Patent: Sep. 26, 2000

[54] BEACH TOWEL FOR SINGLES

[76] Inventor: Michael J. Taylor, 2120 Garden Valley Way, Grants Pass, Oreg. 97527

[21] Appl. No.: 08/727,221

[22] Filed: Oct. 8, 1996

[51] Int. Cl.[7] ..... A47G 9/06

[52] U.S. Cl. ..... 5/417; D6/603; D6/608

[58] Field of Search ..... D6/595, 608, 596–599, D6/603; 5/417–420

[56] References Cited

U.S. PATENT DOCUMENTS

| | | | |
|---|---|---|---|
| D. 326,205 | 5/1992 | Secreet | D6/608 |
| D. 341,285 | 11/1993 | Kraus | D6/595 |
| D. 351,755 | 10/1994 | Hrebenar | D6/599 |
| D. 354,650 | 1/1995 | Hrebenar | D6/599 |
| D. 355,096 | 2/1995 | Lang | D6/595 |
| 4,512,049 | 4/1985 | Henry | 5/417 |
| 4,654,906 | 4/1987 | Roberts | 5/417 |
| 4,800,602 | 1/1989 | Luery | 5/417 |
| 5,072,467 | 12/1991 | Hunt | 5/417 |
| 5,269,033 | 12/1993 | Reid et al. | 5/417 |
| 5,390,381 | 2/1995 | LaMantia | 5/417 |
| 5,406,659 | 4/1995 | Camp | 5/417 |
| 5,499,411 | 3/1996 | Wong | 5/417 |

OTHER PUBLICATIONS

Miles Kimball Catalog, 1978, p. 26 "Kitchen Chic Aprons".
Washington Post, May 21, 1972, "If you're tired of asking:".

*Primary Examiner*—Lloyd A. Gall
*Assistant Examiner*—Gary Estremsky
*Attorney, Agent, or Firm*—Patent & Trademark Services; Joseph H. McGlynn

[57] ABSTRACT

A functional beach towel for unmarried people is described. The towel is divided into two sections, each section having one or more inscriptions printed thereon which encourage unmarried people to sit and converse. The inscriptions may include, but are not limited to, phrases such as "room for one more", or "I'm single", and so on.

1 Claim, 1 Drawing Sheet

BEACH TOWEL FOR SINGLES

BACKGROUND OF THE INVENTION

The present invention relates generally to beach towels, and in particular to a functional beach towel for single people, having messages printed thereon which encourage other singles to sit and converse.

DESCRIPTION OF THE PRIOR ART

A variety of ornamental beach towel designs have been claimed in the prior art. For example, U.S. Pat. Nos. D. 351,755 and D. 354,650 claim beach towel designs depicting the outline of male and female body shapes.

U.S. Pat. No. D. 326,205 claims a design having the phrase "be happy", and U.S. Pat. Nos. D. 341,285 and D. 355,096 disclose designs having a kangaroo and a compass, respectively. These designs are interesting and attractive, but they do not invite conversation from other people on the beach.

SUMMARY OF THE INVENTION

The present invention is a beach towel which is functional, in the sense of soliciting and encouraging social interaction between singles at the beach or pool. The towel is constructed of terry cloth or other suitable fabric, and is large enough for two persons to recline comfortably thereon. The towel has a design printed thereon which divides the towel into two equal sections. One section contains one or more printed messages which encourage single persons to sit on the towel and chat. The messages may include, but are not limited to, such phrases as "this spot not taken", "room for one more", and so on. The beach towel of the present invention thus performs a function which is often very difficult for single people to do by themselves, namely, to invite other singles to sit and talk.

Accordingly, it is an object of this invention to provide an improved beach towel.

It is a further object of this invention to provide a beach towel which is functional in the sense of soliciting and encouraging social interaction between single persons at a beach or pool.

These and other objects and advantages of the present invention will become apparent from the detailed description below, when taken in conjunction with the annexed drawings.

DESCRIPTION OF THE PREFERRED EMBODIMENTS

Figure 1:
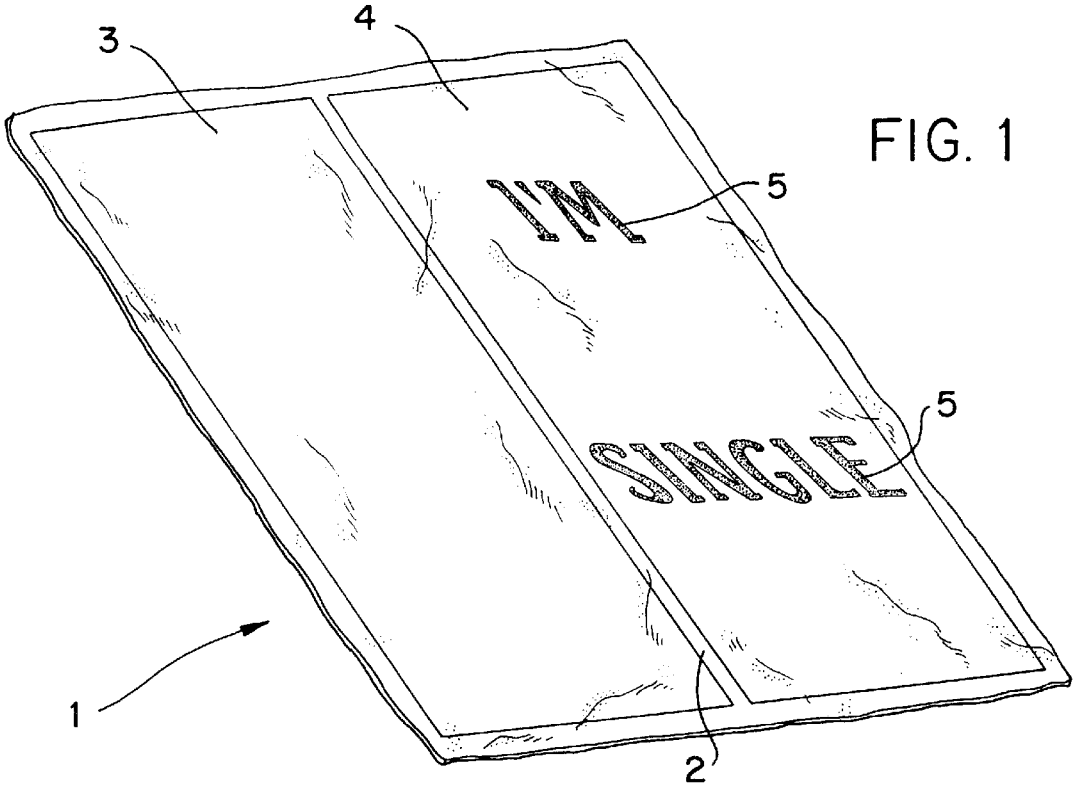
FIG. 1 shows a perspective view of one embodiment of the present invention.

Referring now to the drawings in greater detail, an embodiment of the beach towel of the present invention 1 can be seen in FIG. 1 having a center line 2 dividing the towel 1 into equal sections 3, 4. One section 3 is left blank, while the other section 4 contains an inscription 5 indicating that other singles are welcome to sit and converse. The inscription 5 may consist of various phrases, including but not limited to "sit here", "this spot not taken", and so on.

Figure 2:
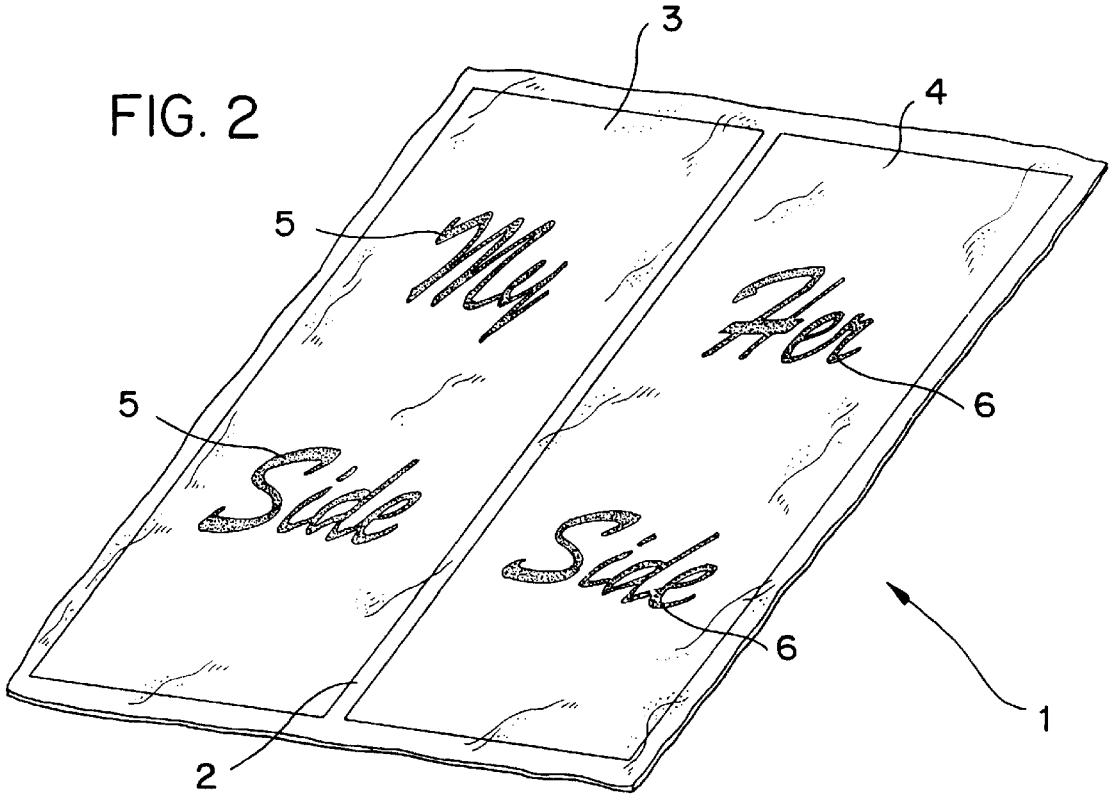
FIG. 2 shows a perspective view of an additional embodiment of the present invention.

FIG. 2 illustrates an alternative embodiment of the present invention 1. In this embodiment, both sections 3, 4 contain inscriptions 5, 6 indicating that the beach towel 1 has enough room for two people. As shown in FIG. 2, the inscriptions 5, 6 consist of the phrases "my side" and "her side", although other invitational inscriptions may be used without departing from the scope of the invention.

The beach towel 1 may be constructed from terry cloth or other suitable fabric, and should be large enough to accommodate at least two people comfortably. The inscriptions 5, 6 and the dividing line 2 may be silkscreened, dyed, sewn, or otherwise inscribed onto the towel 1 by any suitable means.

Although the beach towel and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A beach towel for singles comprising:

fabric means for absorbing water, said fabric means having a length and a width, means extending along said length for dividing said fabric into spaces for more than one individual, and means on only one of said spaces for presenting a message to people who see said fabric means, and wherein said means for absorbing water is a material which is thick and highly absorbent, and wherein said means for dividing said fabric into spaces is a dividing line placed vertically on said fabric, and wherein said means for presenting a message is a horizontally imprinted message for indicating the marital status of the owner of said towel.

* * * * *